US006211624B1

(12) United States Patent
Holzer

(10) Patent No.: US 6,211,624 B1
(45) Date of Patent: Apr. 3, 2001

(54) METHOD AND DEVICE FOR THE MODULATION OF THE INTENSITY OF FLUORESCENT LAMPS

(76) Inventor: Walter Holzer, Drosteweg 19, D-88709 Meersburg (DE)

( * ) Notice: Subject to any disclaimer, the term of this patent is extended or adjusted under 35 U.S.C. 154(b) by 0 days.

(21) Appl. No.: 09/242,092

(22) PCT Filed: Aug. 1, 1997

(86) PCT No.: PCT/EP97/04187

§ 371 Date: Feb. 8, 1999

§ 102(e) Date: Feb. 8, 1999

(87) PCT Pub. No.: WO98/07300

PCT Pub. Date: Feb. 19, 1998

(30) Foreign Application Priority Data

Aug. 9, 1996 (DE) ..... 196 32 282

(51) Int. Cl.[7] ..... H05B 37/02

(52) U.S. Cl. ..... 315/224; 315/209 R; 315/DIG. 4; 315/225

(58) Field of Search ..... 315/DIG. 4, 209 R, 315/211, 224, 225, 226, 307, 308, 240, 194, 219, 199

(56) References Cited

U.S. PATENT DOCUMENTS 4,392,086 * 7/1983 Ide et al. ..... 315/174
4,408,185 * 10/1983 Rasmussen ..... 340/310
4,414,493 * 11/1983 Henrich ..... 315/308
5,055,746 * 10/1991 Hu et al. ..... 315/291
5,068,576 * 11/1991 Hu et al. ..... 315/291
5,091,677 * 2/1992 Bleich et al. ..... 315/360
5,107,184 * 4/1992 Hu et al. ..... 315/291
5,629,588 * 5/1997 Oda et al. ..... 315/308
5,675,221 * 10/1997 Yoo et al. ..... 315/291
5,739,643 * 4/1998 Usui ..... 315/241 S
5,896,015 * 4/1999 Mader ..... 315/291

* cited by examiner

*Primary Examiner*—Don Wong
*Assistant Examiner*—Tuyet T. Vo
(74) *Attorney, Agent, or Firm*—Marshall, O'Toole, Gerstein, Murray & Borun

(57) ABSTRACT

The invention describes a method for the modulation of the light intensity of fluorescent lamps via the supply main by modification of the form and/or the amplitude of the power supply provided. An electronic control element, provided as a component of the logical circuit, temporarily blocks current flow after at least every second zero-crossing of the voltage, dependent upon time and/or voltage. Blocking of the current flow occurs only during the time period in which there is no flow of charging current for the downstream direct-current mains supply circuit. The advantage thus obtained is that the control pulses for the logical circuit do not influence the electric current flowing through the fluorescent lamps.

29 Claims, 3 Drawing Sheets

METHOD AND DEVICE FOR THE MODULATION OF THE INTENSITY OF FLUORESCENT LAMPS

BACKGROUND OF THE INVENTION

Because fluorescent lamps cannot be simply dimmed with a phase control like incandescent lamps, numerous suggestions have been made for reducing the brightness by means of group circuits or other methods in residential or business quarters.

This applies especially to fluorescent compact lamps where the fluorescent lamp with a ballast is inserted in the normal lamp socket and therefore only the two mains supply lines are available for modulating the brightness.

For example, the German patent DE 40 37 948 described an arrangement where the compact lamp is switched to two bi-stable switching conditions by short interruptions of the power supply. This arrangement was used in practice but is not satisfactory because it is not adequately comparable with the function of a continually controllable dimmer.

U.S. Pat. No. 5,068,576 introduced another dimmer switch for a fluorescent lamp where a simple two-wire connection is arranged between the dimmer switch and the fluorescent lamp. The control of the logical circuit is performed via the change of the input voltage of a voltage regulator. A microcomputer influences the voltage amount through digital signals. A phase cutting control was described where complete half waves are cut off from the mains alternating voltage. This entails the disadvantage that the cut half waves cause the fluorescent lamp to flicker when dimmed.

SUMMARY OF THE INVENTION

It is the task of this invention to propose a method for dimming fluorescent lamps that is extremely simple to operate, that has a far simpler arrangement and where the fluorescent lamp is not additionally influenced by the control impulses of the logical circuit.

This invention makes this possible by using an electronic control element as a component of the logical circuit in which the block of the current flow occurs only during the time period when there is no charging current for the downstream current mains supply circuit. This has the advantage that control of the logical circuit do not influence the electric current flowing through the fluorescent lamp. Unwanted influences on the light intensity of the fluorescent lamp by control pulses for the logical circuit are thus avoided.

A preferred embodiment for changing the form of the input voltage is that an electronic circuit element is provided as a component which temporarily blocks the current flow at least after every second zero-crossing of the voltage, depending upon time and/or voltage. This circuit does not influence the current supply of the fluorescent lamp when the current flow block occurs only during the time period in which there is no flow of charging current for the downstream direct-current mains supply circuit.

An impulse generator is suggested as another variant for changing the input voltage form that emits its identification impulses only during the time period when there is no charging current for the downstream direct-current mains supply circuit. This embodiment also insures that the identification impulses do not interfere with the power supply of the fluorescent lamp during the brightness adjustment.

In order to prevent influencing the intensity dimmer during brief mains interruptions below 100 milliseconds as they can occur with lightening strikes, the logical circuit can also be blocked during such mains interruptions.

Because a continual control of the light intensity is not desired in many cases, a logical circuit under this invention can be designed in the manner that the logical circuit controls a gradual reduction of brightness to default brightness levels when the current flow is briefly interrupted for more than 100 milliseconds.

The combination of the two features for controlling the logical circuit, namely providing for a change of the net voltage change and also for a brief interruption of the mains supply, is optionally available, for example, in a single contact lamp. This means an important simplification of such circuits because these dimmer circuits can be directly integrated in the upstream device.

Such dimming cannot reach brightness 0. For this reason, the invention suggests that brightness is again increased after reaching a certain minimum brightness during a longer change of the net voltage.

When full brightness is reattained, the invention provides that even in continued net voltage changes the full brightness is maintained and no further reduction phase of brightness occurs.

This measure is necessary to avoid a stronger decrease and increase of brightness during an unwanted decrease of the net voltage, for example at peak consumption. With the suggested measure, such net behavior would indeed introduce a dimming process which, however, would be leveled after a short period of time.

The change of input net voltage can be accomplished under the invention by installing a touch contact in series with the net circuit that has a normally closed rest contact bridging a component that changes the form and/or the amplitude of the input net voltage.

A resistance is proposed as an alternative form of such a component which changes only the amplitude of the input voltage. A relatively small voltage decrease suffices to trigger the logical circuit so that the voltage decrease in the brief period of activation plays practically no role. But the fluorescent lamp receives less power during the brightness control adjustment so that the adjustment suffers a minor distortion when no voltage control occurs in the direct-current mains supply circuit or in the converter.

To implement the process described above, no complicated dimmer is required as before but rather a touch contact is provided in series with the net circuit containing a normally closed rest contact that bridges a resistance or a simple electronic element.

This is completely adequate to control the logical circuit that can be integrated with the electronic upstream device in a common housing resulting in a contact lamp or a contact lamp adapter, respectively, where a threaded socket or a quarter-turn type connector makes the insertion into a lamp fixture possible.

The fluorescent lamp can be optionally connected firmly with, or plugged into such a compact lamp housing.

It is also recommended to combine the mains switch and the touch contact into one unit or, also, to provide the mains switch directly with an additional rest contact that is formed as a touch contact.

BRIEF DESCRIPTION OF THE DRAWINGS

The following FIGS. 1 through 7 serve a better understanding of the inventive thought. They should not be interpreted as limiting and should be understood as exemplary embodiments only.

The schematic figures are explained below in detail.

DETAILED DESCRIPTION OF A PREFERRED EMBODIMENT

Figure 3:
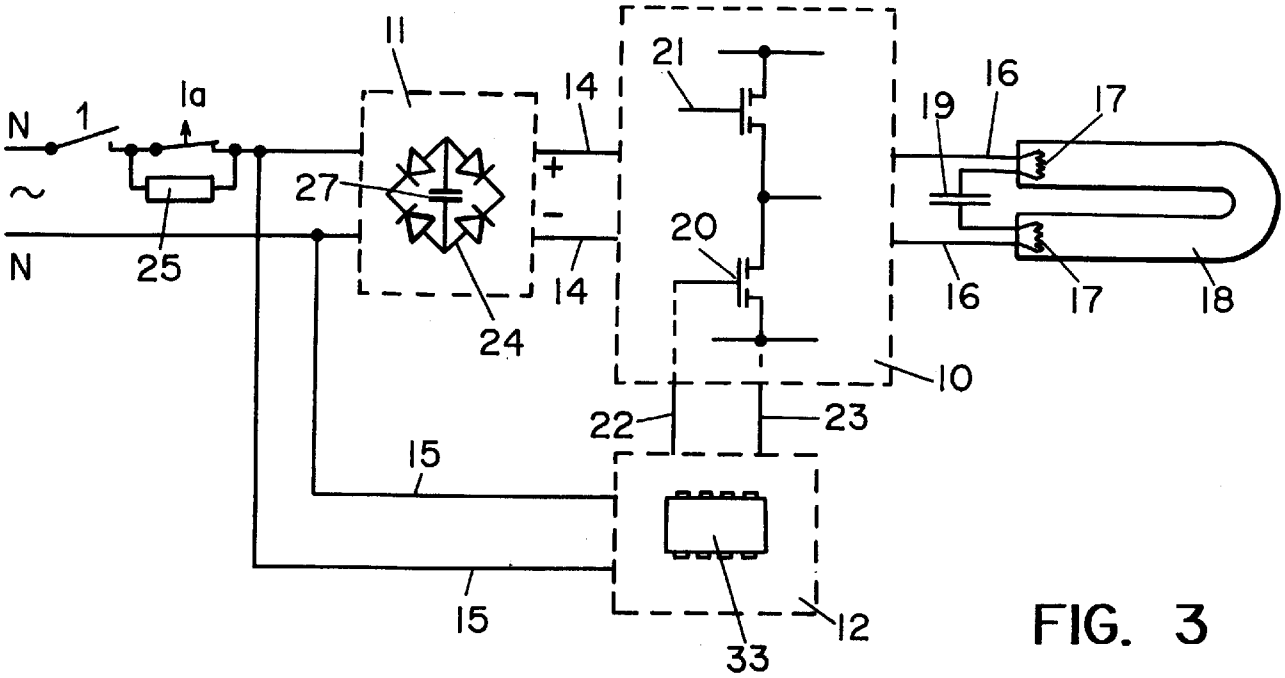
FIGS. 3 and 3*a* show two exemplary embodiments of the circuits under the invention.

The circuit embodiment FIG. 3 shows that an additional touch contact 1*a* is provided in series with the mains switch 1. The rest contact of the touch contact is normally closed. If the touch contact 1*a* is activated, a voltage decrease occurs at resistance 25 and the voltage input to the directcurrent mains supply circuit 11 is changed, i.e., the amplitude is reduced in this case.

Figure 1:
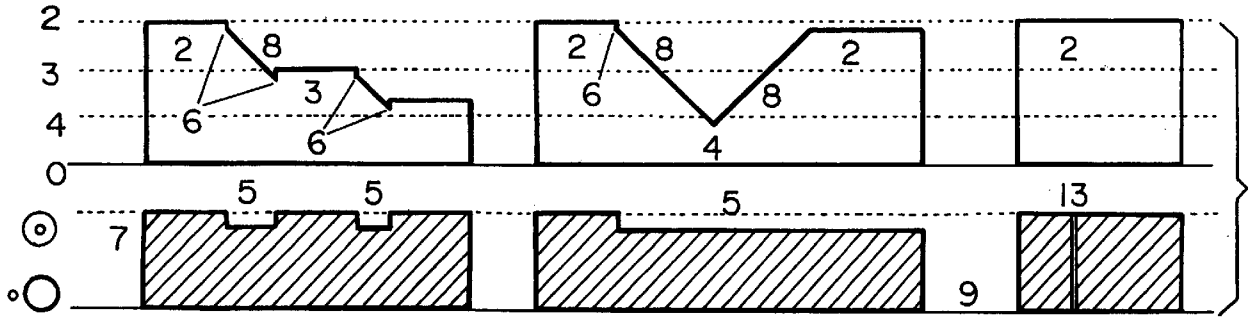
FIG. 1 shows the relationship between the net voltage and the brightness of the fluorescent lamp at full and reduced net voltage with a resistance 25 as the control component.

The logical circuit 12 receives this information via the lines 15 and reacts, for example, as shown in the diagram of FIG. 1. This diagram shows the voltage in the lower part and the corresponding brightness of the fluorescent lamp in the upper part. The manner in which the logical circuit converts the received information into brightness values will be discussed later.

With the first activation of the mains switch 1 at the point in time 6, the fluorescent lamp 18 receives its full brightness 2. As long as a circuit pause 5 is defaulted by activating the contact 1*a*, the logical circuit 12 regulates the brightness of the fluorescent lamp downward. The brightness reaches a mean value 3 in this example. At the points 6, at first a minor reduction and at the end of the control process a minor increase in brightness can be observed because the resistance 25 reduces the input net voltage during this time. Considering the modest cost of such a device, this barely noticeable deviation is undoubtedly acceptable.

In the first example FIG. 1, a second switching pause 5 is shown that leads to a continued reduction of the brightness. Because this second switching pause 5 is shorter than the first, the proportional reduction of brightness is also smaller. Here, too, the deviation of the brightness levels during the control process is visible in the points 6.

The second example in FIG. 1 shows what happens in a sudden voltage reduction of a longer duration that may be caused by the net, for example. The logical circuit 12 holds the signal initially for a command to reduce the brightness and begins with a continual dimming at point 6. Because the supposed signal continues, the brightness sinks to the lowest default value 4. The invention provides that the brightness again increases when this lowest brightness limit is reached. Either the signal ends or the maximum brightness value is reached. The invention provides that the dimming ends at this point to prevent that a continual alteration of the brightness occurs. If the decreased net voltage remains, the maximum brightness reaches only the reduced value shown in FIG. 1.

After a longer pause 9, the lamp is lit at the then possible maximum brightness independent from the previously set brightness.

The illustrated short pause 13 below 100 milliseconds, for example, as it would sometimes occur in power outages, does not influence the brightness.

Figure 1A:
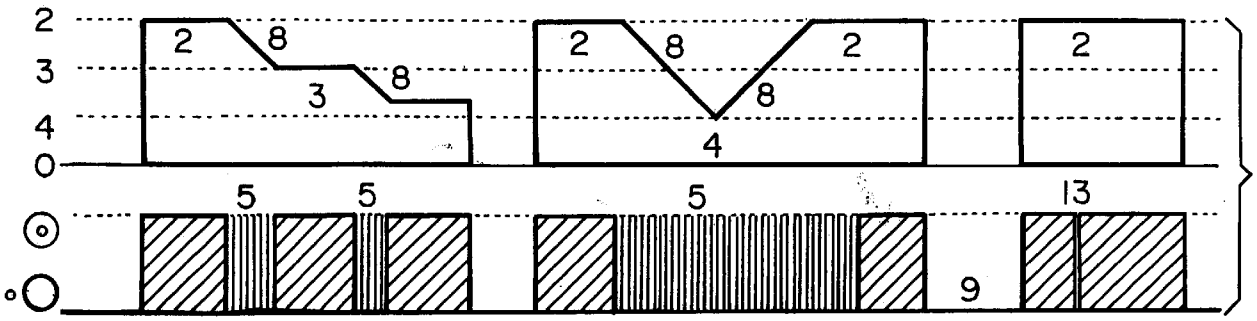
FIG. 1*a* shows the relationship between the net voltage and the brightness of the fluorescent lamp with an electronic circuit element 26 as a current blocking and thus controlling component.

The variant shown in FIG. 1*a* reflects an invented process where an electronic circuit element 26 is provided instead of the resistance 25. The circuit element transmits the dimming command to the logical circuit 12 at a time when no charging current flows to the downstream direct-current mains supply circuit 11, as illustrated in FIGS. 4 through 7.

This is explained as follows: In direct-current mains supply circuits, a charging condenser 27 is charged from the alternating-current circuit via a rectifier circuit 24 and supplies the required current generally via a converter 10 to the fluorescent lamp 18. However, current from the net can only charge the condenser via the rectifier circuit 24 when the momentary value of the alternating voltage is higher than the direct voltage at the charging condenser 27.

Figure 5:
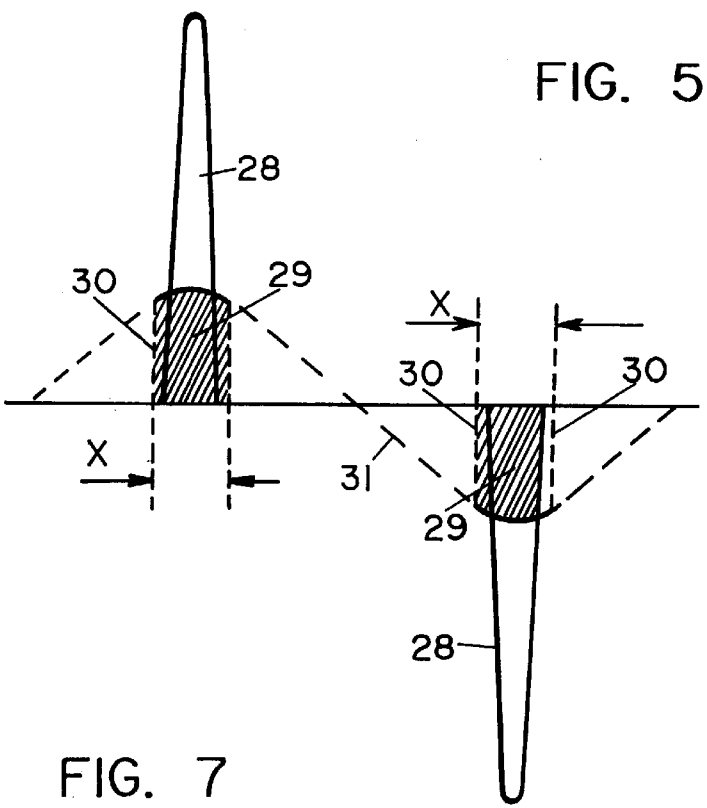
FIG. 5 shows the form of the input net voltage and of the current with a gate circuit as the blocking component.
Figure 4:
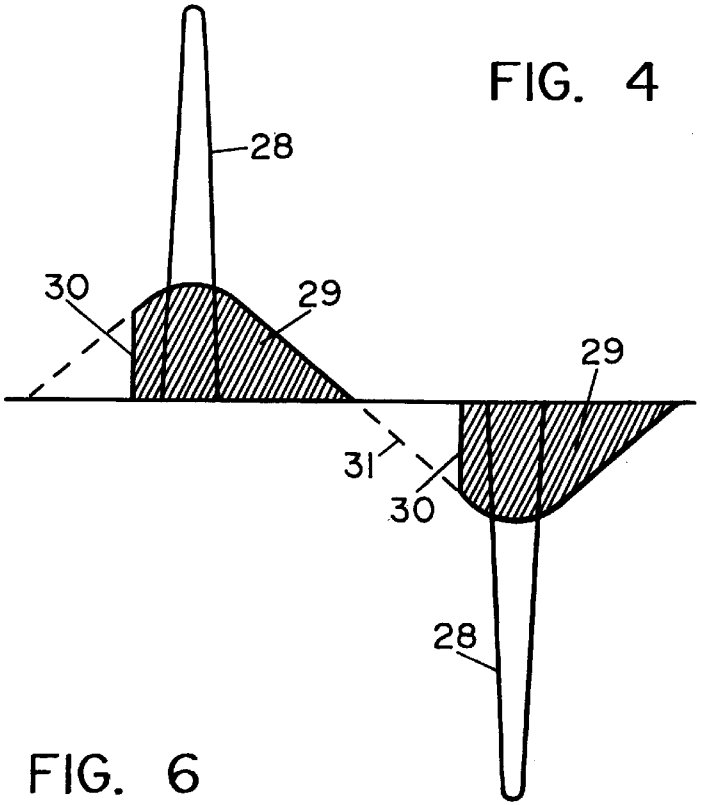
FIG. 4 shows the form of the input net voltage and of the current with an electronic circuit element 26 as a blocking component.

This, however, only applies to a small areas of the alternating-current half waves, as shown in FIGS. 4 and 5. Accordingly, the current flows only in the comparatively short positive and negative current peaks 28. In the intermediate times, the net voltage can be freely changed or modulated with impulses without influencing the current intake of the fluorescent lamp and without influencing its brightness.

With reference to FIG. 1*a*, this means that information can be sent to the logical circuit 12 with electronic circuit elements 26 without influencing the power supply of the rectifier mains 11. The electronic circuit elements 26 interrupt the net voltage at every zero-crossing of the voltage for a brief time, depending upon time and/or voltage, as shown in FIG. 4. The duration of this information, corresponding with the activation of the touch contact 1*a*, selects the desired brightness of the fluorescent lamp 18.

The three embodiments in FIG. 1*a* correspond with those in FIG. 1 but do not show the unwanted brightness deviations at the points 6.

Figure 7:
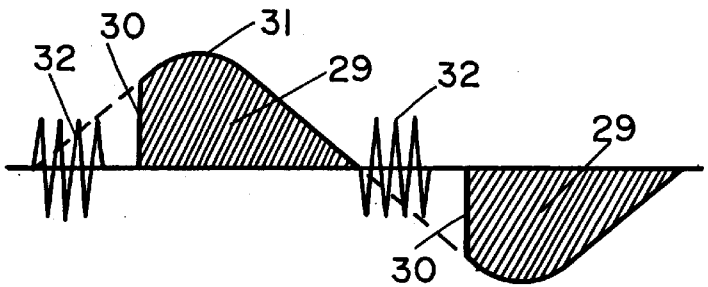
FIG. 7 shows the form of the input net voltage and of the current with an additional impulse generator as component 7.
Figure 6:
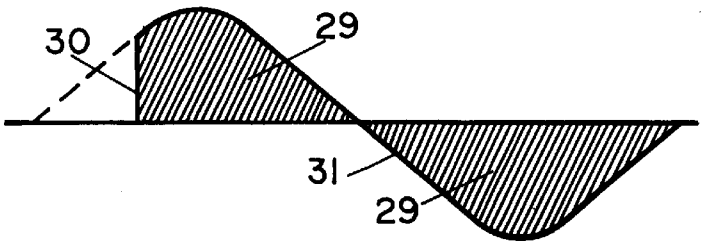
FIG. 6 shows the form of the input net voltage in an external simple embodiment of the electronic circuit element 26 as the blocking component.

The same brightness control without deviations is also possible with other electronic devices 26 whose functions are shown in FIGS. 5, 6 and 7. FIG. 5 shows the function of an electronic gate switch. It opens the current gate only in certain segments of the alternating-current half waves. These current gates are marked with x in FIG. 5. It is easy for the logical circuit to determine if the gate function is activated or not. The duration of the progressive dimming proceeds accordingly.

The diagrams in FIGS. 4 through 7 show the possible current flow times as dotted areas 29 in the sinus-shaped voltage line 31.

An additional modulation with overlapping impulses 32 at higher frequencies, as shown in FIG. 7, can only recommended for especially demanding solutions. In most cases, even a change of the two half waves is not needed. This applies to all examples cited.

For completeness' sake, an additional modulation or an emission of impulses with higher frequencies is shown during the touch pauses 5 with the shaded areas in FIG. 1*a*. It is understood that an influence on the brightness through short interruptions is impossible in circuits of this type.

FIG. 6 shows how such an extremely simple circuit can function under the invention by only affecting one half wave and still causing an adequate change of the form of the net current to activate the logical circuit 12.

It is of equal value for the invented process whether the areas 29 of the voltage carrying areas or the activation and deactivation flanks 30 of the electronic circuit elements 26 are used as the information for the logical circuit 12. The described solutions are only intended as examples for all circuits functioning in the same manner.

Figure 2:
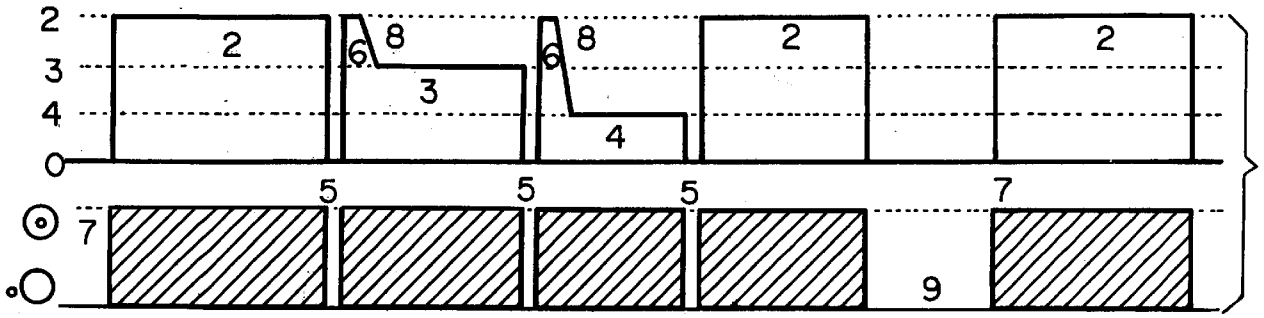
FIG. 2 shows the relationship between the net voltage and the brightness of the fluorescent lamp when the brightness is controlled by deactivation impulses.

The German patent application DE 129 29 207.7 described a gradual brightness adjustment through an interruption of the net voltage. Its function is illustrated in FIG. 2. The principle difference lies the fact that after each short interruption 5 exceeding 100 milliseconds, the fluorescent lamp must be extinguished and relit. The relighting occurs with full current at point 6 to attain a full lighting, but the brightness is dimmed gradually in two steps 3 and 4, for example, by interrupting twice at the points 8. The brightness levels are cyclically controlled. After longer pauses 9, the full brightness is activated, regardless of the previously activated level.

This circuit cannot be compared with the invention under discussion, but its combination with a gradual process brings significant advantages. If the logical circuit is designed so that it reacts to both signal types, namely "change of form and/or of net voltage amplitude" and "interruption of net voltage," the brightness of a compact lamp of this type can be regulated with all described processes and advantages. Because the logical circuit 12 can only be an integrated circuit, such a combination would barely entail additional costs, but this synergistic effect makes the lamp significantly more advantageous. The model streamlining allows for significant cost savings through the universal use of a single lamp type.

The common functions of the individual components will be discussed on the example illustrated in FIG. 3 to explain the invention.

The net voltage from the net N—N reaches the direct-current mains switch 11 via the main switch 1 and the touch switch 1*a* with the parallel resistance 25 or an electronic circuit 26. The direct-current mains switch supplies the core of the upstream device, the converter 10, with current via the lines 14. The logical circuit 12 receives its information which brightness level is desired from the net with its downstream components.

The logical circuit 12 has the task of recognizing and interpreting the changes or interruptions caused by the touch switch 1*a* or the net switch 1 in order to transmit the corresponding commands via the lines 22 and 23 to the converter 10. Of the multitude of possibilities to modulate the brightness of a fluorescent lamp 18, a proven embodiment of an DC/AC converter with two opposing field effect transistors 20 and 21 is offered as an example. The converter 10 converts the direct voltage supplied by the direct- current mains supply circuit 11 in a high frequency alternating voltage that is delivered via the lines 16 to the heated cathodes 17 with the condenser 19 arranged in series. As soon as the cathodes 17 are sufficiently heated and ready for emission, the fluorescent lamp 18 is lit.

The brightness of the fluorescent lamp 18 depends essentially on the provided effective electric current. This can be regulated by the frequency but also by the touch ratio of the half waves of transistors 20 and 21. Both can be controlled by an integrated circuit 33 which is a part of the logical circuit 12. All circuit details are part of the standard knowledge of any electronic specialist and require no further explanation. They can also be looked up in a textbook.

A special advantage of the invention lies in the fact that no dimmer or special device is necessary. Only an additional touch switch 1*a* with a resistor 25 or a minute electronic circuit 26 is required to change the traditional incandescent lamps to dimmable fluorescent lamps under the invention.

Figure 3B:
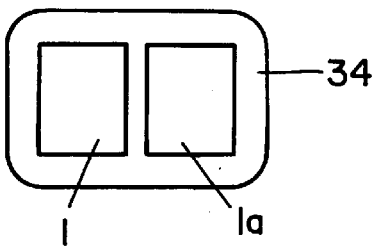
FIG. 3*b* shows an example of a circuit combination.
Figure 3A:
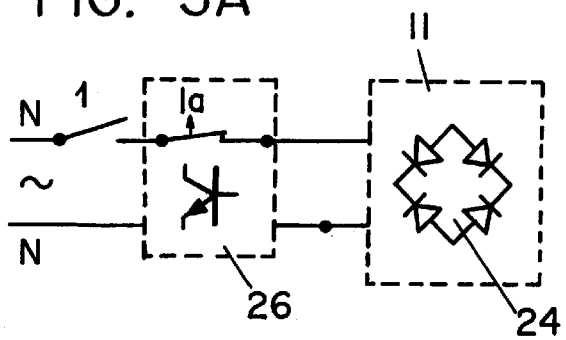

The components resistor 25 or electronic circuit 26 are so small that they can be housed, according to the invention, in a normal double toggle switch that also contains the power switch 1 as well as touch switch which simplifies operation (see FIG. 3*b*). Here, too, the design possibilities are endless. Also, a spring controlled switch could be used.

LEGEND

1 mains switch
1*a* touch contact
2 full brightness
3 medium brightness
4 low brightness
5 touch pause
6 point
7 component
8 ramp
9 longer disconnect pause
10 converter
11 direct-current mains supply circuit
12 logical circuit
13 short interruption
14 lines
15 lines
16 lines
17 heated cathodes
18 fluorescent lamp
19 condenser
20 MOS-FET (metal oxide semiconductor field effect transistor)
21 circuit symmetrical MOS-FET
22 line
23 line
24 rectifier circuit
25 resistance
N—N alternating-current net
2*x* gates
26 electronic circuits
27 charging condenser
28 current peaks
29 areas
30 flanks
31 sinus-shaped voltage lines
32 superimposed impulses
33 IC integrated circuit
34 double toggle switch

What is claimed is:

1. For use with a fluorescent lamp, an apparatus for adjusting the brightness of the lamp comprising:

a power supply having an input for receiving an input voltage and a charging current;

a DC/AC converter coupled downstream of the power supply and having an output for delivering current to the lamp;

a switch in communication with the input of the power supply;

an electronic circuit responsive to a state change of the switch to cause a reduction in the input voltage if there is no flow of charging current to the power supply; and a control circuit cooperating with the DC/AC converter in response to the reduction in the input voltage to control the current delivered to the lamp.

2. An apparatus as defined in claim 1 wherein the electronic circuit temporarily prevents charging current from flowing to the power supply during a predefined blocking period occurring after at least every second zero crossing of the input voltage waveform.

3. An apparatus as defined in claim 1 wherein the electronic circuit temporarily prevents charging current from flowing to the power supply during predefined blocking periods occurring after every zero crossing of the input voltage waveform.

4. An apparatus as defined in claim 1 wherein the control circuit and the DC/AC converter control the current delivered to the lamp to produce a gradual dimming of the lamp.

5. An apparatus as defined in claim 1 wherein the control circuit is adapted to distinguish between reductions in the input voltage caused by the electronic circuit and reductions in the input voltage caused by power disturbances.

6. An apparatus as defined in claim 5 wherein the control circuit reduces the current delivered to the lamp to a predefined minimum level and thereafter returns the current to its initial level if the reduction in the input voltage lasts longer than a predetermined time period.

7. An apparatus as defined in claim 5 wherein the control circuit does not change the current delivered to the lamp if the reduction in the input voltage has a duration under a threshold length.

8. An apparatus as defined in claim 7 wherein the threshold length is approximately 100 milliseconds.

9. An apparatus for adjusting a brightness of a fluorescent lamp, the apparatus comprising:

a power supply having an input for receiving an input voltage;

a switch having a first state and a second state;

a logic circuit for altering the brightness of the fluorescent lamp in response to a reduction of the input voltage;

an electronic circuit for reducing the input voltage whenever: (a) the switch is in the second state, and (b) no charging current is required by the power supply occur simultaneously; and wherein the logic circuit does not alter the brightness in response to reductions in the input voltage with a duration below a predefined threshold duration.

10. An apparatus as defined in claim 9 wherein the logic circuit is programmed to gradually reduce the brightness toward a default brightness level as long as (a) the switch is in the second state, and (b) no charging current is required by the power supply.

11. An apparatus as defined in claim 9 wherein the logic circuit is programmed to gradually reduce the brightness if the reduction in the input voltage lasts longer than the predefined threshold duration.

12. An apparatus as defined in claim 11 wherein the predefined threshold duration is approximately 100 milliseconds.

13. An apparatus for adjusting a brightness of a fluorescent lamp, the apparatus comprising:

a power supply having an input for receiving an input voltage and a storage capacitor with an associated charging voltage;

a switch having a first state and a second state;

a logic circuit for altering the brightness of the fluorescent lamp in response to a reduction of the input voltage; and an electronic circuit for reducing the input voltage whenever: (a) the switch is in the second state, and (b) a momentary value of the input voltage is lower than the charging voltage of the storage capacitor.

14. An apparatus as defined in claim 13 wherein the electronic circuit releases the input voltage at least at each second half wave of the input voltage when the momentary value of the input voltage is lower than the charging voltage of the storage capacitor.

15. An apparatus as defined in claim 13 wherein the electronic circuit is in communication with the logic circuit, and the electronic circuit communicates the reduction of input voltage to the logic circuit via impulse signals which occur only during time periods in which the momentary value of the input voltage is lower than the charging voltage of the storage capacitor.

16. An apparatus as defined in claim 13 wherein the switch comprises a touch contact with a normally closed rest contact.

17. An apparatus as defined in claim 13 wherein the logic circuit does not alter the brightness in response to reductions in the input voltage with a duration below a predefined threshold duration.

18. An apparatus as defined in claim 17 wherein the logic circuit is programmed to gradually reduce the brightness toward a default brightness level as long as (a) the switch is in the second state, and (b) the momentary value of the input voltage is lower than the charging voltage of the storage capacitor.

19. An apparatus as defined in claim 17 wherein the logic circuit is programmed to gradually reduce the brightness if the reduction in the input voltage lasts longer than the predefined threshold duration.

20. An apparatus as defined in claim 19 wherein the predefined threshold duration is approximately 100 milliseconds.

21. An apparatus for adjusting a brightness of a fluorescent lamp, the apparatus comprising:

a power supply having an input for receiving an input voltage;

a switch having a first state and a second state;

a resistive impedance in parallel with the switch for reducing the input voltage when the switch is in the second state; and a logic circuit in communication with the input for altering the brightness of the fluorescent lamp in response to a reduction of the input voltage; wherein the logic circuit alters the brightness based upon a length of time that the input voltage is reduced.

22. An apparatus as defined in claim 21 wherein the resistive impedance and the logic circuit are located in a common housing that has a socket and can be placed in a lamp fixture.

23. An apparatus as defined in claim 21 wherein the logic circuit alters the brightness in proportion to a length of time that the switch is in the second state unless the switch is in the second state for longer than a predetermined length of time.

24. An apparatus as defined in claim 21 wherein the logic circuit does not alter the brightness in response to reductions in the input voltage with a duration below a predefined threshold duration.

25. An apparatus as defined in claim 24 wherein the logic circuit is programmed to gradually reduce the brightness if the reduction in the input voltage lasts longer than the predefined threshold duration.

26. An apparatus as defined in claim 25 wherein the predefined threshold duration is approximately 100 milliseconds.

27. An apparatus as defined in claim 21 wherein the logic circuit alters the brightness by reducing the brightness toward a default brightness level.

28. An apparatus as defined in claim 27 wherein, if the brightness reaches the default brightness level and the switch is still in the second state, the logic circuit increases the brightness level toward a second default brightness level.

29. An apparatus as defined in claim 27 wherein, if the brightness reaches the second default brightness level and the switch is still in the second state, the logic circuit stops altering the brightness until the switch exits and re-enters the second state.

* * * * *